US006102817A

United States Patent [19]

Boswell

[11] Patent Number: 6,102,817

[45] Date of Patent: Aug. 15, 2000

[54] MEASURING DEVICE TO SPEED GOLF PLAY

[76] Inventor: James W. Boswell, 1196 Carraige Way N., E. Lansing, Mich. 48823

[21] Appl. No.: 09/296,501

[22] Filed: Apr. 22, 1999

Related U.S. Application Data

[60] Provisional application No. 60/085,435, May 14, 1998.

[51] Int. Cl.[7] ..... A63B 57/00

[52] U.S. Cl. ..... 473/407

[58] Field of Search ..... 473/405, 407, 473/176; 269/43, 251, 249; 294/19.1

[56] References Cited

U.S. PATENT DOCUMENTS

| | | | |
|---|---|---|---|
| 214,364 | 7/1879 | Goss | 264/251 |
| 1,070,049 | 8/1913 | Machava | 269/251 |
| 2,903,929 | 9/1959 | McVey | 269/249 |
| 3,204,599 | 9/1965 | Milosch | 473/176 |
| 4,273,329 | 6/1981 | Trigg et al. | 473/407 |
| 4,880,232 | 11/1989 | Lang | 473/176 |
| 4,905,624 | 3/1990 | Krolzick | 473/176 |
| 5,149,071 | 9/1992 | Oliveira | 269/43 |
| 5,860,197 | 1/1999 | Fox | 269/249 |

*Primary Examiner*—Steven Wong
*Attorney, Agent, or Firm*—Harness, Dickey & Pierce, P.L.C.

[57] ABSTRACT

A device to speed golf play by accurately and quickly measuring distances a golf ball lies from a turnable flagstick (20 FIG. 1A, mozat part of invention) containing two similar bodies (10 and 11 FIGS. 1 and 2) wrapped centrally around said flagstick with a 90 degree rotational measuring arm (22 FIG. 5) held in a slot (15 FIG. 2A) by a pin (14 FIG. 2) with a plumb bob (29 FIG. 5) at one end pointing downward from a numbered position to pinpoint the exact distance toward said turnable flagstick within which measure a putted golf ball must lie for the next putt to be counted and conceded so that the ball may be picked up without putting. When not in use, a gripping device (23 FIG. 5) at the outer end of arm (22 FIG. 5) will hold said arm (22 FIG. 5) to flagstick (20 FIG. 1A) when rotated 45 degrees upward.

10 Claims, 6 Drawing Sheets

MEASURING DEVICE TO SPEED GOLF PLAY

CROSS REFERENCE TO RELATED APPLICATION

This application is entitled to the benefit of Provisional Patent Application Ser. No. 60/035,435 filed May 14, 1998.

STATEMENT REGARDING FEDERALLY SPONSORED RESEARCH

Not applicable.

FIELD OF INVENTION

This invention relates to reducing the time golfers spend needlessly on the putting green by providing a fixed measuring device of distance standards on the flagstick for conceding putts.

DESCRIPTION OF PRIOR ART

As far as the patent applicant is aware, there is only unsuccessful prior practice rather than prior art to reduce time spent on the putting green while playing a round of golf. The United States Golf Association, while it decries speed of play in public statements, maintains that it, along with the Royal and Ancient group in England, governs all Rules of Play for golf including amateur status and equipment, yet has done nothing in its rule making role to deter player malingering and speed green movement of the players. The Professional Golf Association Tour, which has its own set of rules based on the other association's Rules of Play, only uses stroke penalties, fines, admonitions, and disqualification to motivate its members to keep up the pace of play on and off a putting green. The slowness and deliberateness of professional play is communicated via television and during actual play to the interested public as being the accepted way play should progress during a round of golf.

It is with reference to these conditioning practices for all golfers as put forth by these monopolistic golf organizations with their ineffective rules and practices governing speed of play that the invention is directed specifically to play on the putting green.

It may well be that these associations are not sincere in their admonitions to speed up play because their economic successes and monopolies prevent outsider solutions to the problem as this invention amply demonstrates. Although the inventor would prefer to have his invention endorsed by these associations and their memberships, and a place provided for the invention in their Rules of Play, particularly for the overwhelming majority of average, non-professional golfers not involved in the existing bureaucracies, the invention can still be commercialized, albeit with more difficulty, through the managements of local golf courses. Even that avenue, due to the associations inroads into local golf course management, is tentative due to interrelated agreements which may slow down or prevent local golf course acceptance.

Local golf courses, particularly those of a more public nature where play may be heavier than private venues, who see this as an economic problem are making more and more statements to their clientele about overall speed of play which includes needless time spent on the putting green trying to emulate the professional.

The United States Golf Association Rules of Play state briefly and simply in Section I Etiquette and Pace of Play:

"In the interest of all, players should play without delay." Its Rule 17(3) The Flagstick states: "The player's ball shall not strike . . . (e) the flagstick in the hole, unattended, when the ball has been played from the putting green."

This specific rule thus makes it necessary to waste time attending to the flagstick and that waste of time for the vast majority of golfers is reinforced in their mindsets as appropriate by what they witness on television and during actual play during professional tournaments.

It simply is not necessary to remove the flagstick while putting from the green. It does not even need to be an option when putting while on the green and the rule or practice should be to never remove the flagstick. Flagsticks occupy the very center of their holes and there is ample room for a putted ball, the same as for a ball hit off the green, to drop into that 4.25 inch diameter aperture with its standard 0.5 inch diameter flagstick which leaves a space of 1.875 inch for the 1.68 inch ball to fall into. The fact a ball can go into the hole with the flagstick occupying it is proved by the million of holes-in-one made from extremely long distances away from the green.

SUMMARY

The present invention is a measuring device outside player influence comprising a main body of at least two parts with a centralized flagstick means of attachment, one part of which has a slot into which an arm is affixed and can protrude outwardly or perpendicularly from the flagstick and from which a plumb bob device would drop toward the ground via gravity through apertures at a predetermined distance from the center of the hold and, when not pinpointing outward distances, said arm can be rotated forty-five degrees upwardly where it can be fixed to the said flagstick by means of a clip or gripping device. In case of a competitive dispute the plumb bob points to a spot determining the distance from the hole the ball must be touching or within in order that the next stroke be conceded and said ball can be picked up ending that player's play on the hole while using an adoptable rules measure not requiring outside input.

Objects and Advantages

Accordingly, despite any objects and advantages of the historic unpatented and formalized practice within the Rules of Golf used by any association and perceived play of golf professionals, several objects and advantages of the present invention are:

(a) to provide a standardized measuring device for all golfers which will advise them that it is unnecessary to make another putting stroke and that they can pick up the ball and move towards finishing their round of golf.

(b) to provide an educational device for golf associations, golf course managers, and golfers on the course itself and on practice facilities which will change the current behavior of players which existing Rules of Play and accepted practice have encouraged.

(c) to provide a specific measuring and educational device for golf associations with sovereignty over golf rules to change their rules rationally in order to speed up play with the same formality that governs other rules of play.

(d) to provide a device which will bring the existing monopolies of the existing golf industry, where applicable, to the attention of Congressional and judicial authorities, and thereby provide for changes in the existing elite structures that currently rule the golf industry.

(e) to provide a device which can be used for advertising purposes by those wishing to expose their images to millions of golfers, to golf courses, and to golf associations.

Further objects and advantages will become apparent from a consideration of the ensuing description and drawings.

DRAWING FIGURES

In the drawings, closely related figures have the same number but different alphabetical suffixes.

Figure 6A:
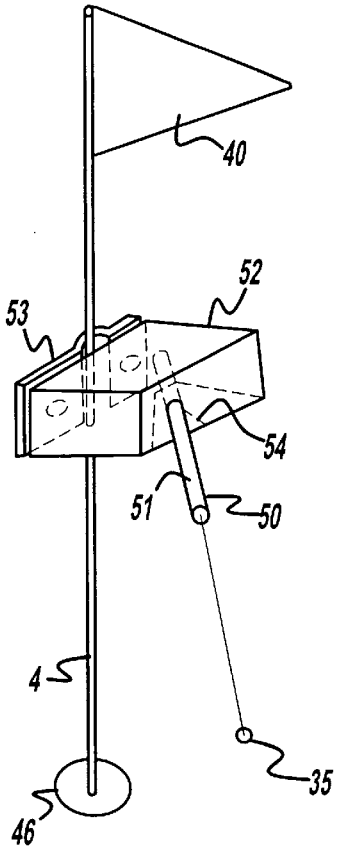

FIG. 6A, an alternative embodiment, is a perspective view of a flagstick using a laser pen to measure distance on the ground.

Figure 6B:
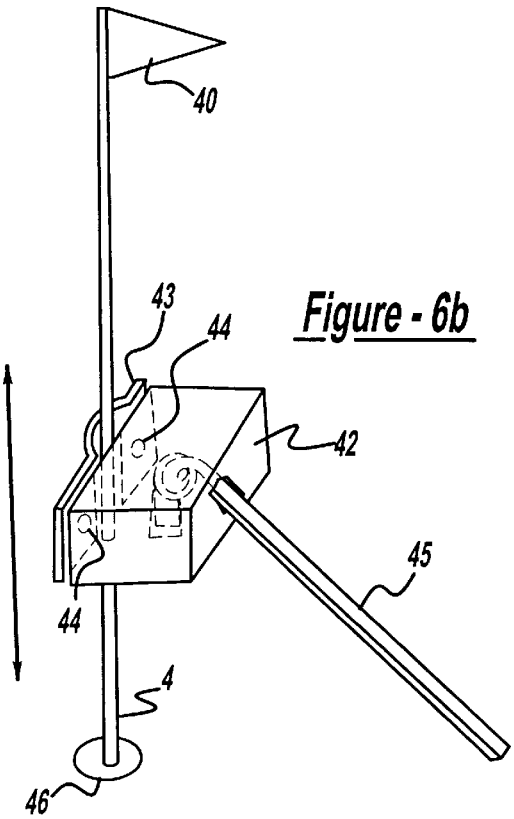

FIG. 6B, an alternative embodiment, is a perspective view of a flagstick using a tape measure or stringlike attachment to measure distance on the ground.

Reference Numerals in Drawings

| | | | |
|---|---|---|---|
| 10 | Back Body | 11 | Front Body |
| 12 | Connector Bolt | 13 | Connector Nut |
| 14 | Swivel Pin | 15 | Arm Slot |
| 16 | Bolt Aperture | 17 | Swivel Pin Aperture |
| 18 | Thumb Screw Aperture | 19 | Thumb Screw |
| 20 | Flag Stick | 21 | Flag Stick Aperture |
| 22 | Arm | 23 | Gripper |
| 24 | 18 inch Aperture | 25 | 24 inch Aperture |
| 26 | Gripper Bolt | 27 | Gripper Nut |
| 28 | Gripper Aperture | 29 | Plumb Bob |
| 30 | Angle of 45 Degrees | | |

DESCRIPTION

FIGS. 1, 2, 1A, 2A, 3, 4, and 5. Preferred Embodiment A preferred embodiment of the measuring device to speed golf play of the present invention is initially illustrated in FIG. 1 (back body 10) and FIG. 2 (front body 11). These two parts, 10 and 11, can be bolted together using connecting bolt 12 and nut 13 through front to back apertures 16. When used, front and back bodies, 10 and 11, will have a round flagstick, 20 FIG. 1A, firmly connected to the two bodies at an appropriate upward height in aperture 21 of both 10 and 11. Flagstick aperture 21 has a standard industry diameter which aperture 21 can be manufactured to that size when drilling, molding, or casting bodies 10 and 11. A suitable method can be used with wood, plastic, or metals and 10 and 11 bodies can be made from one whole part (say 4"×4"×4") and cut into two equal size parts (say 4"×4"×2" each ) or those two separate parts can be the objective. The bodies 10 and 11 can be of a circular or squarish (as shown) or rectangular design. The sides where flagstick 20 FIG. 1A and bodies 10 and 11 adjoin must conform to or match each other closely.

Figures 1, 2:
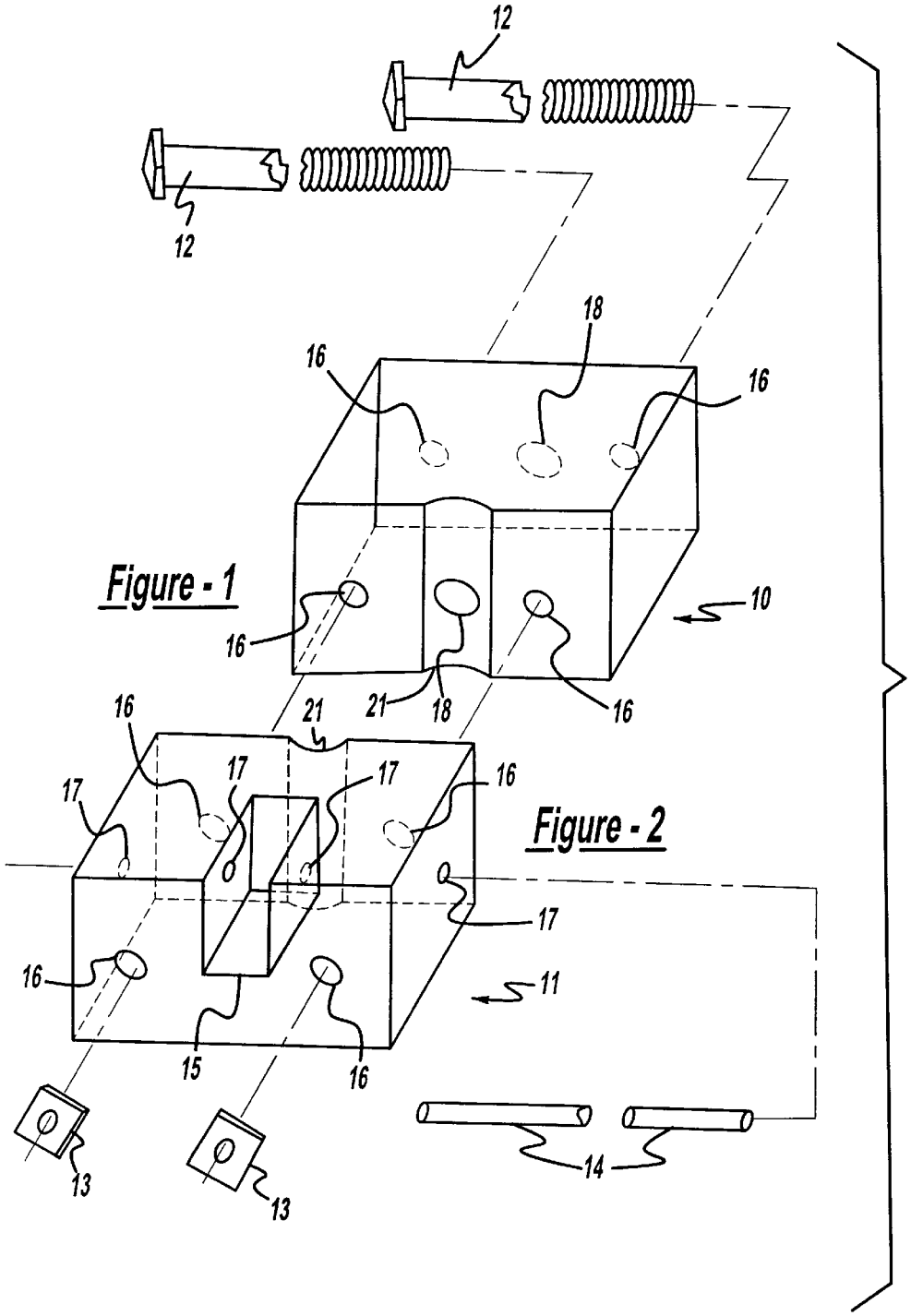
FIG. 1 shows one half of a measuring device body (the back) with apertures for connecting it to the other half, plus the shared connecting bolts, an aperture for holding a circular golf flagstick (not shown and not part of this invention)), and apertures for a thumb screw (not shown) retaining device.
FIG. 2 shows one half of a measuring device body (its front) with apertures for connecting it to the back half, along with shared connecting devices, one half of an aperture for holding a circular golf flag stick (not shown), and apertures for a swivel pin (shown) which will retain an arm (not shown).
Figure 1A:
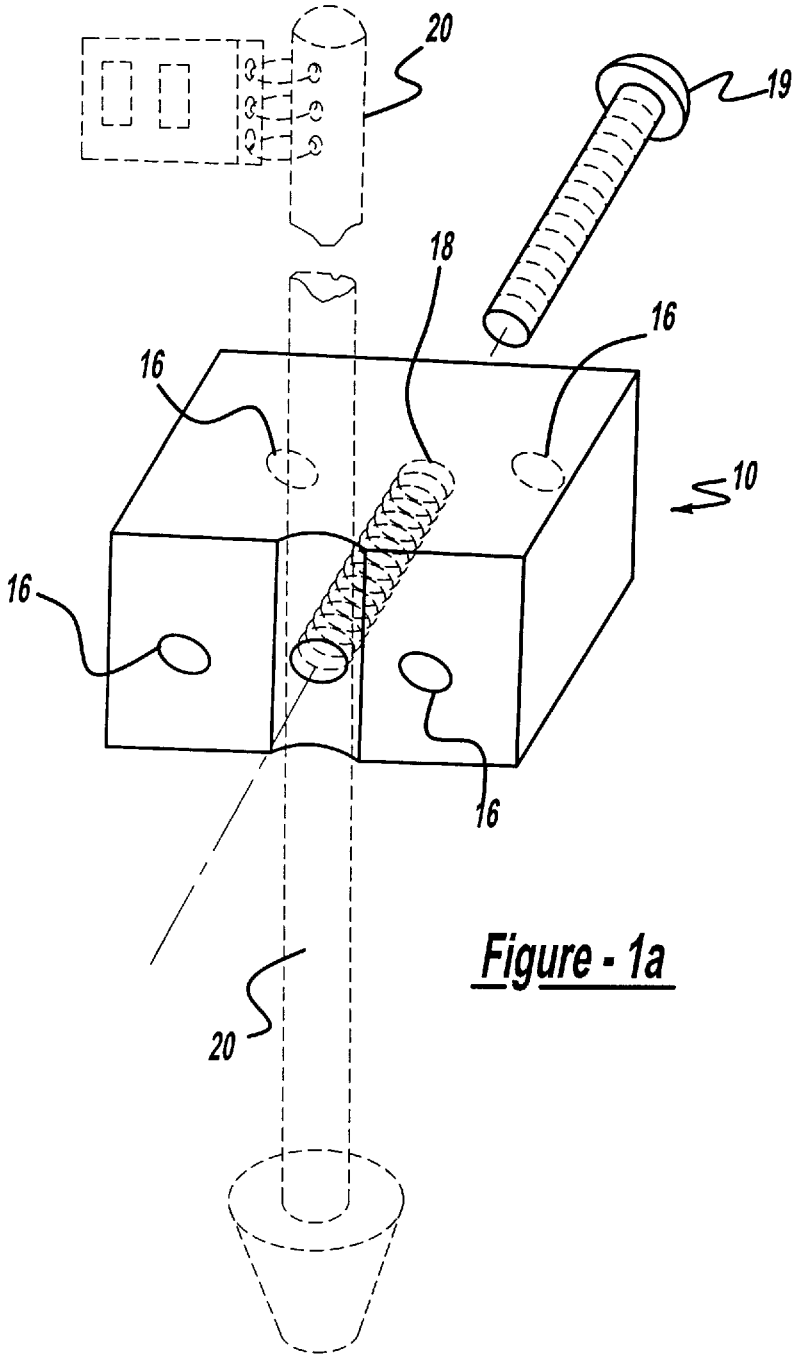
FIG. 1A shows FIG 1 with a more descriptive view of an aperture for holding a thumb screw which will help retain the measuring bodies to a flagstick.
Figure 2A:
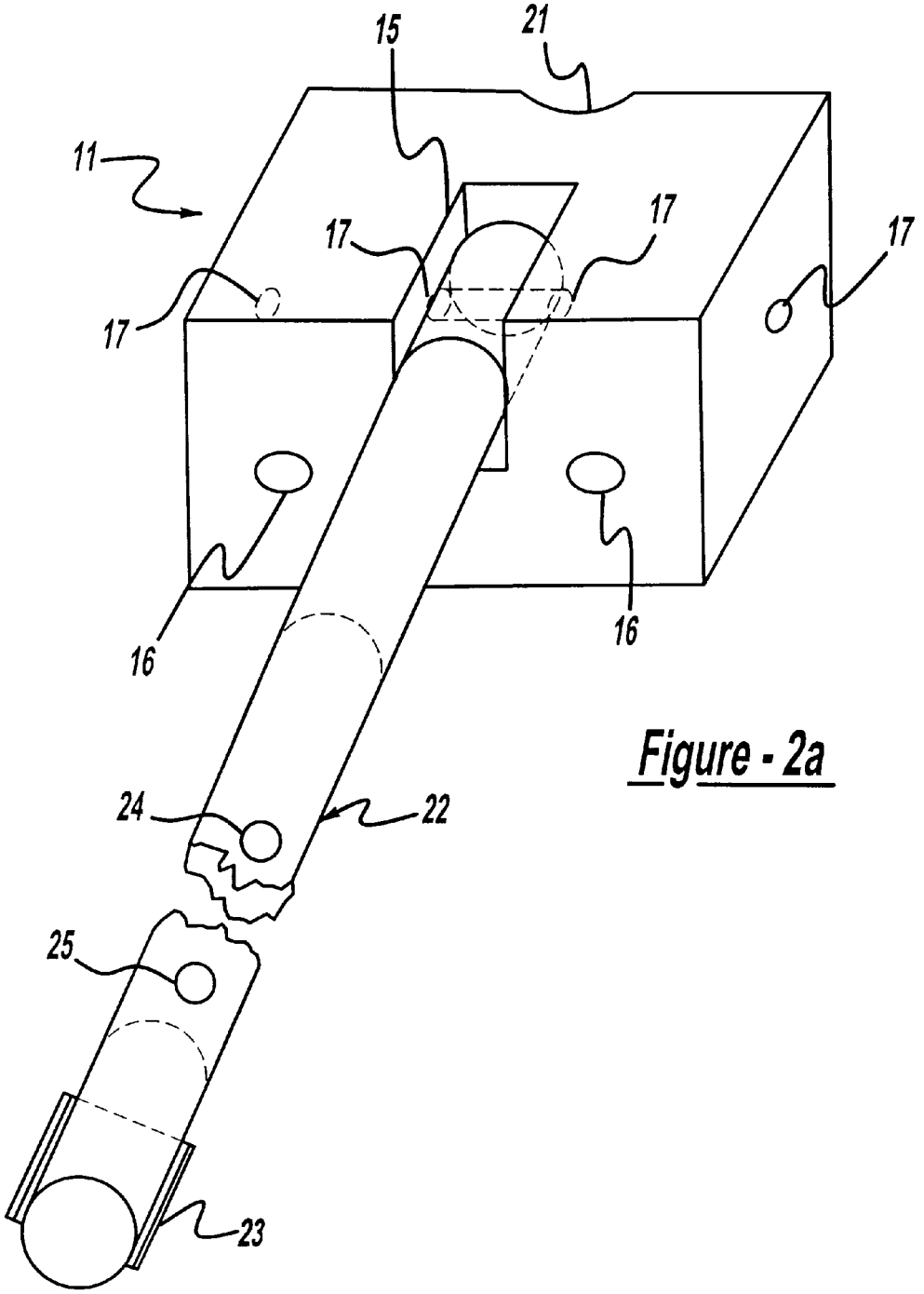
FIG. 2A shows FIG. 2 with a dowel type arm held in place by a dowel type pin in a slot, and at the other end of the arm is a device to grip a flagstick in an upright, out-of-the way position.

At the front of front body 11 FIG. 2 is a slot 15 into which a dowel type arm 22 FIG. 2A can be inserted and held in place with swivel pin 14 FIG. 2. A round swivel pin 14 FIG. 5 enables arm 22 FIG. 5 to swivel up or down, to or away from, flagstick 20 FIG. 1A at angle of forty-five degrees 30 FIG. 5.

In the preferred embodiment a thumb screw 19-FIG. 1A is inserted into threaded aperture 18 and helps tighten front and back bodies 10 and 11 to flagstick 20 FIG. 1A during assembly.

Figure 3:
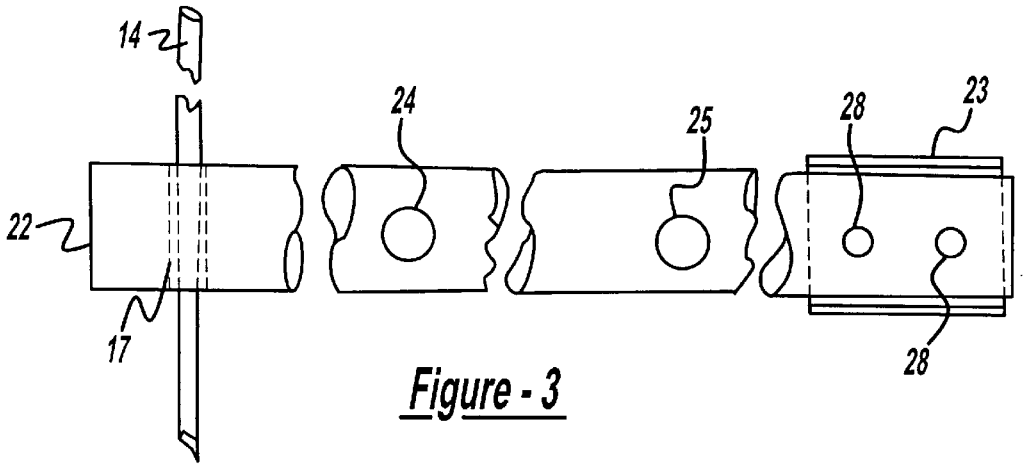
FIG. 3 shows the swivel arm with a pin through one end and the gripping device at the other end.
Figure 4:
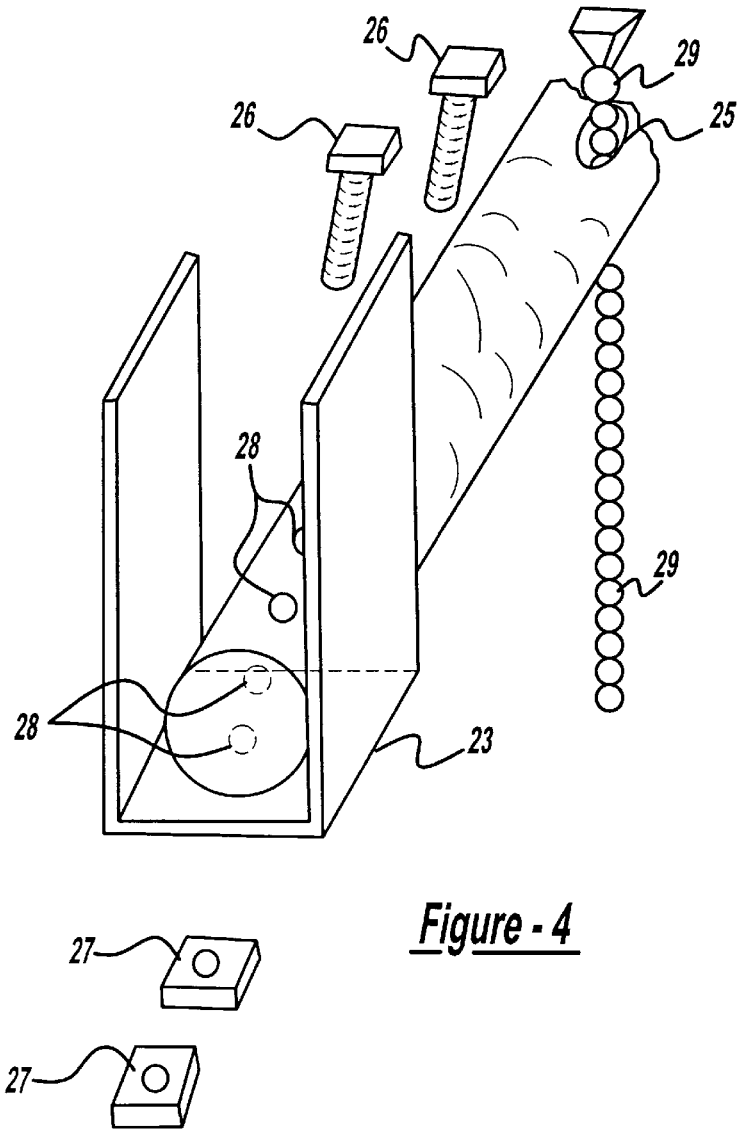
FIG. 4 shows the extended end of the swivel arm with its gripper connectors and the plumb bob device through its aperture which will point to and measure the appropriate distance to the center of the flag stick.

Swivel pin 14 and arm 22 are shown in greater detail in FIG. 3 as well as a top down view of a gripping device 23 which is also shown in greater perspective detail in FIG. 4 along with its possible connection method, nuts and bolts 26 and 27 through aperture 28. Also in FIG. 4, the preferred embodiment illustrates a plumb bob device 29 extending itself downward via gravity through aperture 25.

Figure 5:
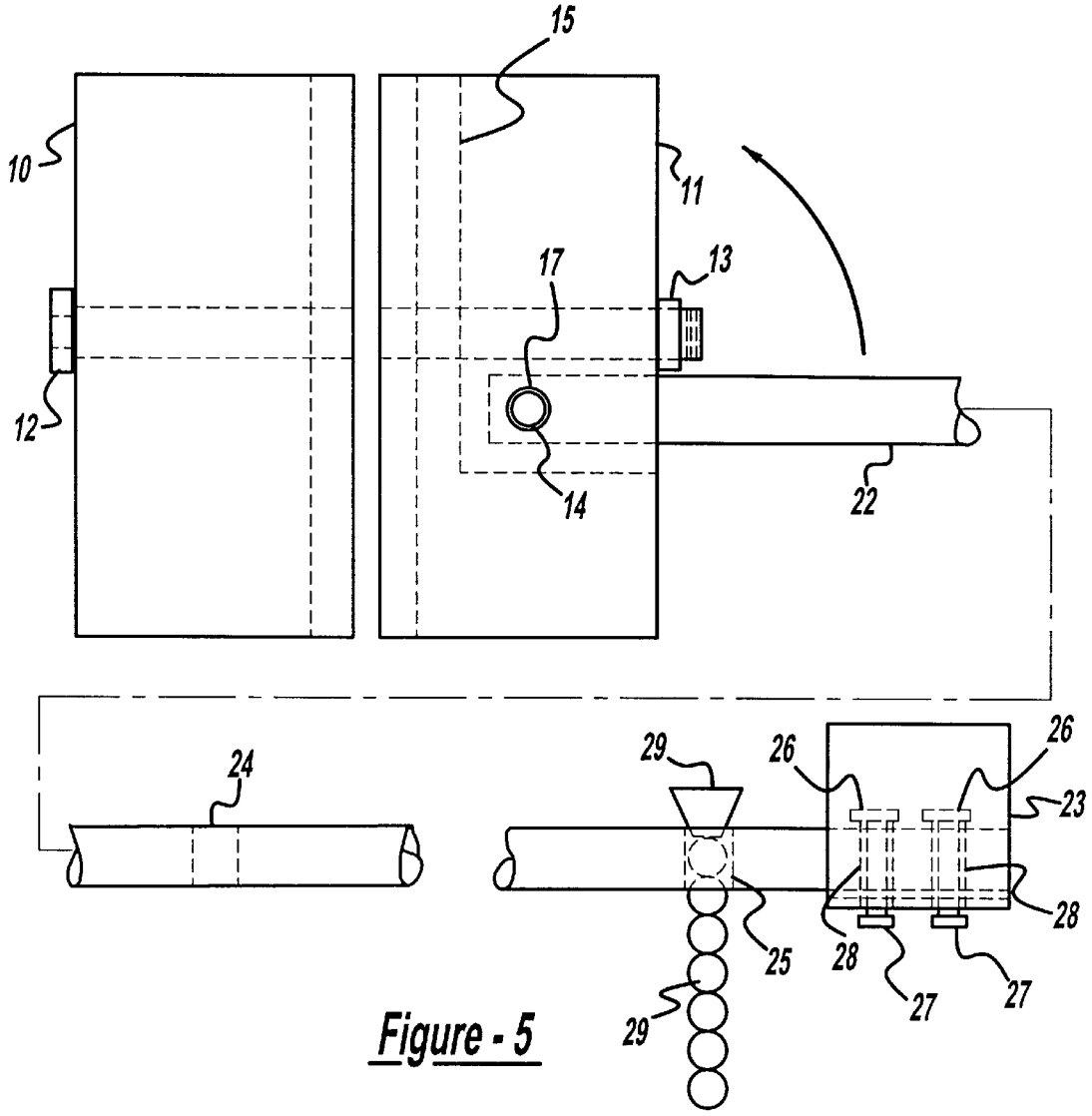
FIG. 5 shows a side orthogonal view of the two connected bodies without a flagstick with the swivel arm extended out and the plumb bob fallen toward the ground with the gripper held in place by connectors.

FIG. 5 is an orthogonal view of the two front and back bodies 10 and 11 brought together in assembly by bolt 12 without the flagstick 20 FIG. 1A in its aperture 21 shown in hidden format. In addition, FIG. 5 shows swivel arm 22 held in place by swivel pin 14 in aperture 17 with plumb bob 29 in place in its aperture 25 which aperture 25 is the 24 inch distance measurement from the center of a golf hole and flagstick 20 FIG. 1A. Other distance measurements are possible as indicated by aperture 24 FIG. 3 and 5, an 18 inch distance measure.

Gripping device 23 clamps upraised arm 14 with plumb bob 29 then falling parallel (not shown) to flagstick 20 FIG. 1A when device is in place and no measurement is needed.

Bodies 10 and 11 are similar overall except that front body 11 has a slot 15 and no thumbscrew aperture 18 while back body 10 has no slot but has thumb screw aperture 18. Front and back bodies 10 and 11 could both be manufactured (not shown) with a slot 15 and thumb screw aperture 18 by a slight enlargement of top to bottom dimensions. This could reduce unit molding or casting costs. As shown, bodies 10 and 11 approximate 4 inch by 4 inch by 2 inch objects.

Connection of the assembled parts to flagstick 20 FIG. 1A at a golf site would be made at a height on the flagstick of about two feet above ground and would be a one time assembly project with no maintenance unless a destructive golfer vandalized the device. That height would be determined by the length of plumb bob 29 which would be approximately two inches from ground level when a measurement is taken. In addition, the assembly is not intrusive to the quiet nature of the golfing scene.

Operation

FIGS. 1, 1A, 2, 2A, 3, 4, and 5

The operation of the preferred embodiment of the present invention requires some discussion of the Rules of Play that are substantially involved in operational use.

During the play of a round of golf, golfers will approach a green and someone will ask other players who are on the green if they wish flagstick 20 FIG. 1A should be (1) attended or (2) removed and discarded to one side out of the way of all putts of other golfers. Each player has the option, attend or remove. Even if the player is unaccompanied, he/she must, according to Rules of Play, remove flagstick 20 and lay it to one side while putting from the green. If more than one golfer is involved, each has the same option, attend or discard. This is a time consuming procedure made necessary by Rule 17-3(e). More time is consumed when Flagstick 20 has to be replaced when the players have all finished.

If flagstick 20 FIG. 1A is left in its hole while putting occurs with the present invention assembled and attached properly, swivel arm 14 FIG. 5 would be parallel and upward with flagstick 20, clamped to it by gripper 23, and plumb bob 29 would also be parallel to flagstick 20 FIG. 1A and falling earthward. No player would be forced to remove and discard flagstick 20 FIG. 1A. Each player would attend to his/her putt in the proper order, furthest from the hole first.

When a putt is obviously closer than two feet or a foot and a half, whatever measure a golf course utilizes as appropriate, the golfer picks up the ball and has completed the hole by adding one more stroke to his/her score. He/she can proceed to the next hole. If there is a dispute as to the closeness of the putt to flagstick 20 FIG. 1A, swivel arm 14 can be ungripped from flagstick 20 FIG. 1A and lowered 45 degrees parallel to the ground using slot 15 FIG. 1 for support at flagstick 20 junction and plumb bob 29, now pointing earthward, will determine if the ball is inside or outside of the required distance to concede or not concede a next putt.

Under some conditions of play, a rules committee governing competition may still require removal of a flagstick when putting from the green. The present invention assembled on a flagstick would not prevent that ruling and it would remain a part of the flagstick which usually has other appendages.

But under some conditions of play, local rules established by a golf course or a rules committee could supercede and change current Rules of Play. The present invention would facilitate local rules committees to change Rule 17 allowing use of the present invention.

As players are conditioned to putt with flagstick 20 FIG. 1A in the hole, they will move more quickly onto and off the green at each hole of play. There will be less duties to perform. It therefore behooves authors of the alleged official Rules of Play to remove the flagstick Rule 17 penalty for hitting the flagstick while putting from the green because the operation of the preferred embodiment, as described, would be within the Rules of Play and achieve the said author's stated goal of faster pace of play.

It should not be forgotten that a flagstick is not part of this invention, but it becomes an integral part when the invention is attached to it. In that important respect, the invention is an unobvious improvement invention of an obvious item (flagsticks) that long ago fell into the public domain.

FIGS. 6A–6B Alternative Embodiments

FIG. 6A–B Reference Numerals in Drawings

| | | |
|---|---|---|
| Flag | 40 | |
| Flagstick | 41 | |
| Tape Box | 42 | |
| Clamp | 43 | to hold Tape Box to Flagstick |
| Connector | 44 | to hold Clamp to Tape Box |
| Tape | 45 | with 18"/24" Markers and Internal Support |
| Golf Hole | 46 | |
| Laser Pen | 50 | |
| On-Off Switch | 51 | |
| Pen Box | 52 | |
| Clamp | 53 | to hold Box to Flagstick with Connectors |
| Support | 54 | for holding Laser Pen at proper angles |
| Red Spot | 55 | |

The problem of flagstick attachment and improvement therefore might be solved electronically by using a laser point pen from a position off green (not shown) and away from immediate access such as a tree or separate pole in the ground holding the laser point pen 50 and directing a red spot 55 toward the desired measure of distance from flagstick 41. But at least three major problems arise including (1) daily changing of the laser spot when hole location is changed; (2) wearing out of the laser beam in pen 50; and (3) loss of the electric charge in the batteries (not shown) requiring attention by greenskeepers. Laser point pen 50 could be clipped at an appropriate place on flagstick 41 and red spot 55 directed toward the distance measurement. A player would have to push on-off switch 51 on the laser pen to determine if putt can be conceded. This would be equivalent to a player, using the preferred embodiment as shown in FIG. 5, having to move swivel arm 22 down 45 degrees so that plumb bob 29 would measure distance. Applicant is not yet convinced that laser spot 55 alternative which pen 50 FIG. 6A and attaching device 52 and 53 FIG. 6A utilize is an efficient high tech substitute for preferred embodiment low tech use of swivel arm 22 FIG. 5 and plumb bob 29 FIG. 5, but it needs mentioning.

Another alternative embodiment would be to create entirely new flagsticks to substitute for those in use with built-in tape or laser measuring capability. Tape measures 45 could be pulled from box 42 in or on flagstick 40 FIG. 6B which could snap back when not in use. In this case the pulled tape 45 replaces swivel arm 22 FIG. 5 and the plumb bob 29 FIG. 5. Again, this solution appears to be too much when a little will do the job. Flagsticks are an expensive item especially when a course might need twenty new ones to replace those which have lasted and will last a long time. FIG. 6B, however, shows a box 42 attached to the existing flagstick 41 with a supported measuring tape 45 including 18" and 24" markers that can be pulled from box 42 and when released by a player (not shown) would retract itself back into the box. Knowing that this alternative would suffer from rain and snow conditions as well as player abusers (to which the preferred embodiment might also suffer), the simplicity of a solid swivel arm 22 FIG. 5 and plumb bob 29 FIG. 5 gives the preferred embodiment an edge over the tape alternative. But it too must be mentioned.

CONCLUSION, RAMIFICATION, AND SCOPE

Accordingly, the reader will see that the preferred embodiment of this invention provides the simplest mechanical solution available for a problem long plaguing important segments of the enormous golf industry including golf course, tournament play, golf associations, and golfers. That problem is slow play around the green during putting and it is due an unnecessary rule and its penalty for hitting the flagstick that occurs only when putting from on the green.

This same embodiment also provides a tool for re-educating golfers regarding the unnecessary rule and can do that re-education at every single hole.

The same embodiment is easily fabricated of several material types, all durable and quite unaffected by adverse weather conditions, and it is uncomplicated in assembly for use and operations.

Two ramifications have also been described that have some negatives at this time to warrant their current dismissal.

Although the description above contains many specificities, these should not be construed as limiting the scope of the invention but as merely providing illustrations of the presently preferred embodiments. Shapes, colors, and materials can be varied.

Thus the scope of the invention should be determined by the appended claims and their legal equivalents, rather than by the examples given.

What is claimed is:

1. A device for measuring a distance between a golf ball and a flagstick, said device comprising:

a body having a front portion and a back portion, said front portion having a first surface, said back portion having a second surface, said front portion having a first bore, said back portion having a second bore, said first bore and said second bore being correspondingly positioned on said front portion and said back portion and being operable to receive the flagstick;

at least one connecting fastener, said at least one connecting fastener releasably connecting said front portion to said back portion;

an adjusting fastener, said adjusting fastener being positioned on one of said front portion and said back portion and being operable to releasably retain said body around the flagstick;

an arm having an end, said arm being positioned on one of said front portion and said back portion, said arm having at least one aperture, said at least one aperture being positioned a predetermined distance away from said end of said arm; and a plumb bob device, said plumb bob device extending vertically downward through said at least one aperture, whereby said first surface of said front portion is operable to mate with said second surface of said back portion when said front portion and said back portion are releasably positioned around the flagstick extending through said first bore and said second bore.

2. The device of claim 1, wherein said arm is pivotally connected to one of said front portion and said back portion.

3. The device of claim 2, wherein said arm includes a connector operable to releasably connect said arm to the flagstick.

4. The device of claim 3, wherein said connector is attached to said arm with at least one bolt.

5. The device of claim 2, wherein said arm is pivotally connected to one of said front portion and said back portion by a swivel pin.

6. The device of claim 1, wherein said at least one connecting fastener is a bolt.

7. The device of claim 1, wherein said adjusting fastener is a screw.

8. The device of claim 1, wherein said body is square.

9. The device of claim 1, wherein one of said front portion and said back portion of said body includes a slot and said end of said arm is positioned within said slot.

10. The device of claim 9, wherein said end of said arm is pivotally connected to one of said front portion and said back portion of said body within said slot.

* * * * *